United States Patent [19]

Lubbers

[11] 4,267,970

[45] May 19, 1981

[54] HOLDER FOR A GUIDING STRUCTURE

[75] Inventor: Marius H. Lubbers, Wassenaar, Netherlands

[73] Assignee: Everts & Van der Weyden Exploitatiemaatschappij Ewem/N.V., The Hague, Netherlands

[21] Appl. No.: 48,041

[22] Filed: Jun. 13, 1979

[30] Foreign Application Priority Data

Jun. 13, 1978 [NL] Netherlands ..... 7806398

[51] Int. Cl.[3] ..... E01B 9/28; E01B 9/44

[52] U.S. Cl. ..... 238/310; 238/265; 238/349; 238/351

[58] Field of Search ..... 238/264, 265, 287, 297, 238/298, 304, 308, 310, 338, 349, 351

[56] References Cited

U.S. PATENT DOCUMENTS

| | | | |
|---|---|---|---|
| 531,862 | 1/1895 | Richards | 238/304 |
| 2,980,336 | 4/1961 | Doll | 238/304 X |

FOREIGN PATENT DOCUMENTS

| | | | |
|---|---|---|---|
| 670649 | 9/1963 | Canada | 238/349 |
| 973492 | 3/1960 | Fed. Rep. of Germany | 238/310 |
| 7309640 | 1/1975 | Netherlands | 238/310 |

*Primary Examiner*—Randolph A. Reese
*Attorney, Agent, or Firm*—John P. Snyder

[57] ABSTRACT

A holder for arranging a rail on a supporting concrete or wooden sleeper, comprising an open housing, which can be engaged by fasteners, comprising anchoring parts, which are embedded in a concrete sleeper or pierced into screwholes in a wooden sleeper, the anchoring parts being located at the corners of an imaginary triangle.

5 Claims, 3 Drawing Figures

HOLDER FOR A GUIDING STRUCTURE

The invention relates to a holder for the arrangement of a guiding structure on a support comprising an open housing, which can be engaged by fastening means for the lateral locking of the guide structure and comprising anchoring parts supporting the housing and engaging the support. A holder of this kind is known from Dutch patent application no. 73.09640.

Such a holder may be employed, for example, for fastening the lateral locking of rails. The holder disclosed in the aforesaid Dutch patent application comprises two anchoring parts included in the support. It has been found that particularly with rails intended for high speed travel and/or high loads very important transverse forces may be involved. The moment thus exerted on the holder gives rise to a risk of the holder getting loose from the support, as a result of which the rail may tilt over.

The present invention has for its object to provide a solution for this problem. According to the invention this is achieved by arranging the anchoring parts at the corners of an imaginary triangle. In this way the holder is supported at three points in the support so that it is capable of absorbing the transverse forces exerted thereon. Various locations of the anchoring parts relative to one another may be imagined. It is preferred to use the solution in which two of the anchoring parts are located in line approximately in the direction of length of the guiding structure. The third anchoring part may be located at a larger distance from the other two from the guiding structure.

In a preferred embodiment the slot of the housing for inserting the fastening means may be directed downwards towards the guiding structure. In this way the fastening means are satisfactorily clamped tight. The angle between the receiving slot and the horizontal may amount to about 10°. The receiving slot may be tapered towards the guiding structure.

The invention will be set out with reference to an embodiment illustrated in the accompanying drawing.

Figure 2:
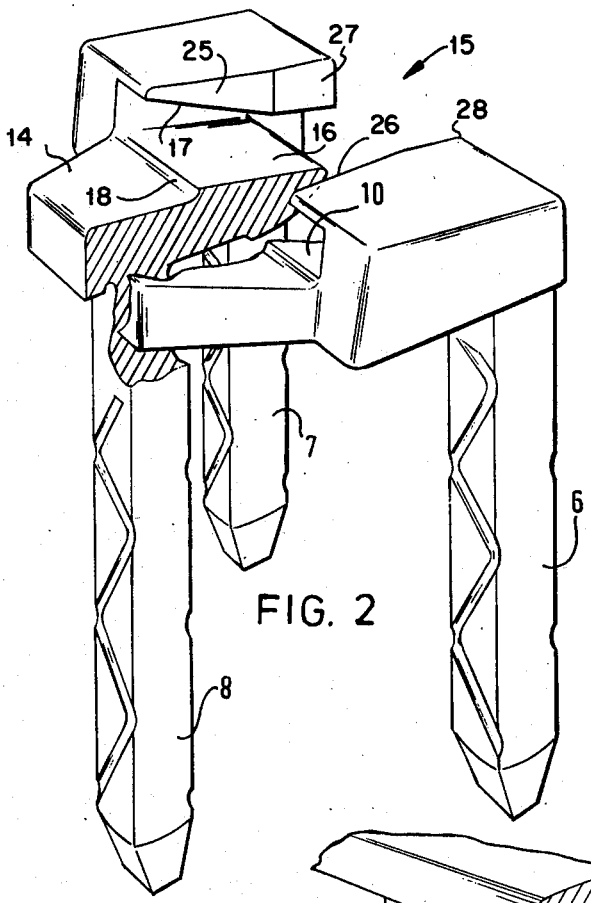
FIG. 2 is a perspective view of the holder in accordance with the invention, some parts being omitted

In the concrete block 1 is embedded a metal holder 2 according to the invention. The housing of the holder 2 projecting above the concrete serves for laterally locking a rail 3, which is fastened to the block 1 with the aid of the elastic clamps 4 and 5, one end of which engages the open side of the housing and the other end of which bears on the foot of the rail 3. The anchoring parts—according to the invention three of them are provided i.e. 6,7 and 8—are inserted into synthetic resin mortar 9 embedded in the concrete block 1. The receiving slot 10 may be directed downwards towards the rail 3. The angle between the receiving slot 10 and the horizontal may be about 10°.

Owing to the three anchoring parts 6,7 and 8 disposed in an imaginary triangle the holder is capable of withstanding transverse forces which will particularly occur under speed travelling conditions.

It should be noted that a wooden support may be used rather than a concrete support.

In this case (see FIG. 3) the holder 2 is mounted on a metal support member 11 by means of the anchoring members 6,7 and 8, which are inserted in holes in support member 11 and the wooden sleeper 12. The holder 2 can be mounted on existing sleepers and support members in which holes are applied for sleeper screws. The anchoring members are inserted in the holes originally intended for the sleeper screws.

The two clamps 4 and 5 are joined by the cross piece or bright 22 whereas their opposite ends 23 and 24 are free, as shown. As is conventional (see, for example, Goderbauer U.S. Pat. No. 4,053,107) this holder or clamp assembly is constructed of spring steel and serves to bear resiliently downwardly at 21 (FIG. 3) on the rail foot to hold it in place. In accord with the construction of this invention, the holder 2 is provided with an extension from which the anchor 8 depends and which presents a generally horizontal upper surface 14 which leads up to the slot whereat the step 18 is formed. Beyond the step 18, the holder is provided with the downwardly sloping floor 16 which cooperates with the downwardly sloping overhang surfaces 17 to define the slot 10. As shown, the slot 10 is interrupted by the channel 15 defined between the inwardly convergent side faces 25 and 26 which lead to the generally parallel side faces 27 and 28.

Figure 1:
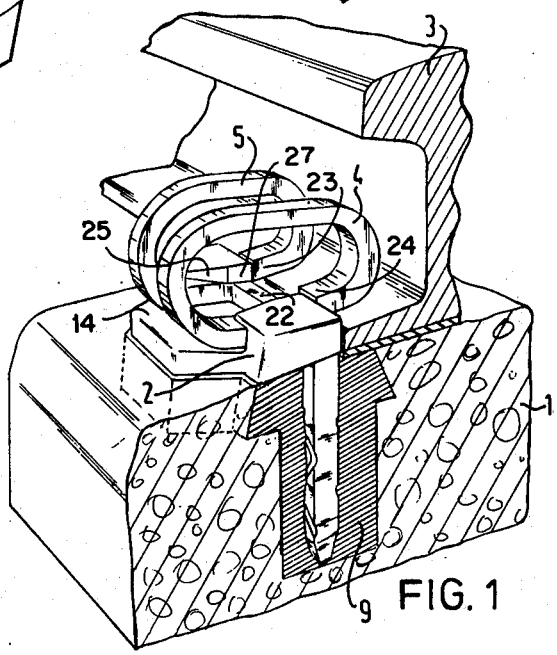
FIG. 1 is a perspective view of a holder in accordance with the invention in the mounted state.
Figure 3:
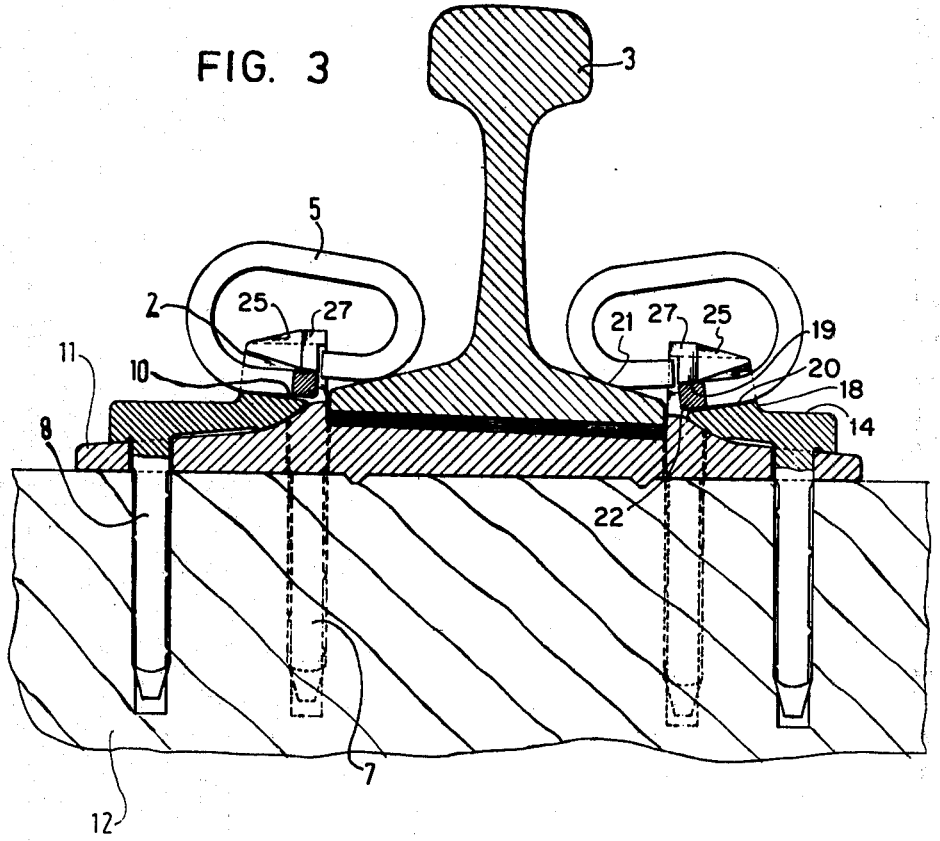
FIG. 3 shows an alternative embodiment of the invention.

This particular construction facilitates the insertion of the clamp such that the bight 18 is finally positioned as shown in FIGS. 1 and 3 to bear upwardly as indicated at 19 against the overhang surfaces 17 while the clamps 4 and 5 bear downwardly as at 20 upon the floor 16 thereby to exact the aforementioned downward pressure at 21. In order to insert each clamp assembly, the free ends 23 and 24 thereof must be forced inwardly toward each other to pass downwardly through the channel 15 ultimately to spring apart at the rear of the overhangs.

What I claim is:

1. A holder for receiving resilient clamping means and adapted to be anchored to a railway sleeper such that the clamping means resiliently bears upon an associated rail foot, said holder comprising a body having a pair of longitudinally spaced upstanding portions having opposed side surfaces defining a channel therebetween, each of said side surfaces including a portion which tapers inwardly with respect to said channel whereby to define, with such portion of the other side surface, a convergent mouth for said channel, each upstanding portion being undercut to define a receiving slot and said body having a downwardly sloping floor defining the bottom of such slot, said body including a laterally projecting portion defining a generally horizontal upper surface leading to said floor, said undercut portions presenting downwardly inclined overhang surfaces spaced above said floor, and said body also including depending anchor posts disposed in a triangular pattern, one below each upstanding portion and one below said laterally projecting portion.

2. A holder as defined in claim 1 wherein said overhang surfaces incline downwardly at a greater angle than said floor.

3. A holder as defined in any one of claims 1 or 2 wherein said floor inclines downwardly at an angle of about 10°.

4. A holder as defined in claim 3 wherein said body provides a step at the juncture of said generally horizontal upper surface with said floor.

5. A holder as defined in any one of claims 1 or 2 wherein said body provides a step at the juncture of said generally horizontal upper surface with said floor.

* * * * *